US005722526A

United States Patent [19]

Sharrard

[11] Patent Number: 5,722,526

[45] Date of Patent: Mar. 3, 1998

[54] DISPENSING SECURITY SYSTEM FOR A VENDING MACHINE

[76] Inventor: Robert C. Sharrard, 2516 West Walton Blvd., Waterford, Mich. 48329-4436

[21] Appl. No.: 557,352

[22] Filed: Nov. 13, 1995

[51] Int. Cl.[6] ..... G07F 7/08

[52] U.S. Cl. ..... 194/346; 235/381

[58] Field of Search ..... 194/205, 210, 194/346; 235/380, 381

[56] References Cited

U.S. PATENT DOCUMENTS

| | | | |
|---|---|---|---|
| 4,230,214 | 10/1980 | Cortez | 194/59 |
| 4,915,205 | 4/1990 | Reid et al. | 194/205 |
| 4,982,072 | 1/1991 | Takigami | 235/384 |
| 5,139,384 | 8/1992 | Tuttobene | 414/281 |
| 5,147,021 | 9/1992 | Maruyama et al. | 194/217 |

FOREIGN PATENT DOCUMENTS

| | | | |
|---|---|---|---|
| 92/01273 | 1/1992 | WIPO | 194/205 |

*Primary Examiner*—F. J. Bartuska
*Attorney, Agent, or Firm*—John Gugliotta; David L. Volk

[57] ABSTRACT

A small computer unit is disclosed that is installable in any standard vending machine that dispenses a product that, by law, is restricted to adult use only, such as cigarette or beer vending machines. An insertion slot is placed on the vending machine to receive the driver's license, and an optical reader then reads the date. A microprocessor then calculates the individuals age based upon the difference between the birth date on the driver's license and the current date, which is maintained by an internal clock. A diverter switch in communication with the coin slot and the coin return is then positioned based upon the user's age. If the user is under a predetermined age, usually either 18 or 21 years old, then the diverter switch directs the coins to pass directly to the coin return, thereby preventing dispensing of product. If the user is of legal age, the diverter switch allows coins to pass into the vending machine in order to operate in a normal conventional manner.

11 Claims, 3 Drawing Sheets

DISPENSING SECURITY SYSTEM FOR A VENDING MACHINE

BACKGROUND OF THE INVENTION

1. Field of the Invention

The present invention relates generally to vending machines and, more particularly, to a security means for preventing the unlawful dispensing to minors of products restricted to adult use, such as tobacco or alcohol, from vending machines.

2. Description of the Related Art

In the related art, many problems associated with vending machines have been addressed. For example, in U.S. Pat. No. 5,147,021, issued in the name of Maruyama et al., a vending machine is disclosed capable of dispensing products paid for with either cash or non-cash payment, such as a credit card. Although making vending machines more accessible, such a device as disclosed in Maruyama et al. has no capability of discriminating the age of the user, and does not solve the problem of underage consumer procuring tobacco or other controlled products utilizing cash.

Also, U.S. Pat. No. 5,139,384, issued in the name of Tuttobene, discloses an article vending machine that requires a user to operate the machine by having an identification card. However, the Tuttobene reference envisions a scenario where a particular user will retrieve and return the same article to the vending machine, such as for videotape cassette rentals. The Tuttobene reference also discloses the use of identifying codes on the products themselves in order to uniquely identify the product dispensed, the party dispense to, and the withdrawal and return date. In essence, disclosed in the Tuttobene reference is a vending machine "library", which cannot be adapted for general dispensing of products to only adult individuals.

Finally, in U.S. Pat. No. 4,230,214, issued in the name of Cortez, a coin operated cigarette case is disclosed in which individual cigarettes are dispensed from the case upon insertion of a coin. Once again, such a device is impractical and unadaptable for use is controlling the dispensing of products to only those of legal purchasing age.

Consequently, a need has been felt for providing an apparatus which can be utilized in conjunction with conventional vending machines, such as cigarette vending machines, in order to limit the purchase of controlled product such as cigarettes to those of legal purchasing limit.

SUMMARY OF THE INVENTION

It is therefore an object of the present invention to provide an improved dispensing security system for a vending machine.

It is another object of the present invention to provide an improved dispensing security system for a vending machine which can prevent product sales to an individual who is younger than the legal purchasing age for such products.

It is a feature of the present invention to provide an improved dispensing security system for a vending machine which requires the user to insert some form of identification, such as a driver's license or state identification card into the machine after depositing coins.

Briefly described according to the preferred embodiment of the present invention, a small computer unit is disclosed that is installable in any standard vending machine that dispenses a product that, by law, is restricted to adult use only, such as cigarette or beer vending machines. An insertion slot is placed on the vending machine to receive the driver's license, and an identification reader then reads the date. A microprocessor then calculates the individuals age based upon the difference between the birth date on the driver's license and the current date, which is maintained by an internal clock. A diverter switch in communication with the coin slot and the coin return is then positioned based upon the user's age. If the user is under a predetermined age, usually either 18 or 21 years old, then the diverter switch directs the coins to pass directly to the coin return, thereby preventing dispensing of product. If the user is of legal age, the diverter switch allows coins to pass into the vending machine in order to operate in a normal conventional manner.

An advantage of the present invention is that vending machines can control distribution of product to only those consumers of legal consumption age.

Another advantage of the present invention is that it can be used in conjunction with the wide variety of vending machines currently available.

Yet another advantage of the present invention is that minors are restricted access to cigarettes or other restricted products.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
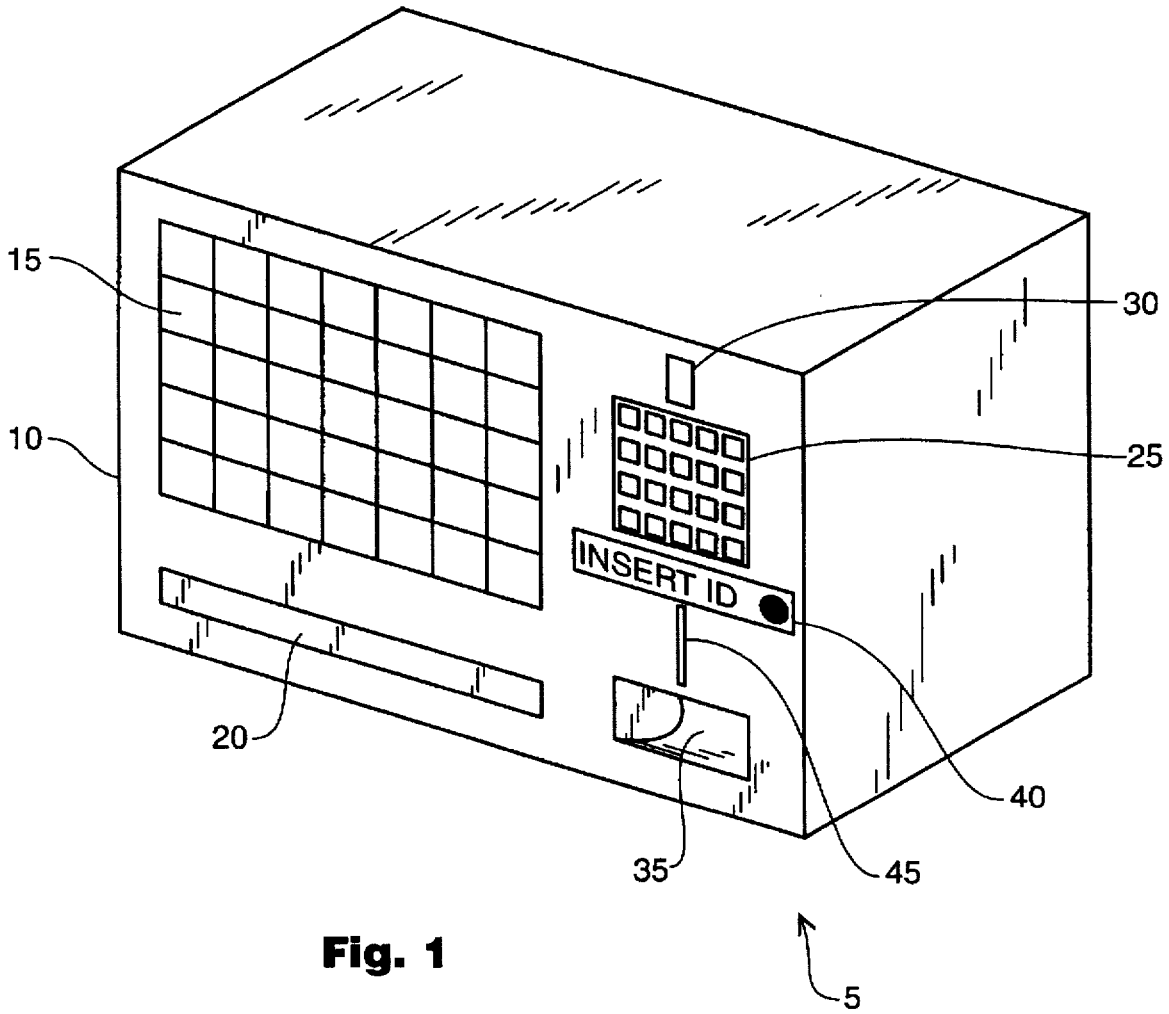
FIG. 1 is a pictorial illustration of a dispensing security system for a vending machine according to a preferred embodiment of the present invention.

Referring now to FIG. 1, a dispensing security system for a vending machine 5 is shown in a pictorial illustration, according to a preferred embodiment of the present invention. A vending machine 10, is provided from which the consumer is to purchase products (not shown). The vending machine 10 provides for the following conventional elements usually associated with a vending machine: a product viewing area 15, a product receiving door 20, a selection means 25, a legal tender insertion slot 30 for insertion of coins, tokens, paper currency, credit cards, debit cards, etc., and a legal tender return chute 35 for return of or change of coins, tokens, paper currency, etc. The vending machine 10 also provides for the following additional elements usually not associated with a vending machine: a ID INSERT light 40 and a identification insertion slot 45. The identification insertion slot 45 is where the user would insert his personal identification card (not shown) bearing his or her age when prompted to do so by the ID INSERT light 40. It is anticipated that the personal identification card (not shown) would be a state government issued identification card such as a driver's license. The birth date of the user would be inscribed on the card by characters capable of being read and interpreted by a optical reader or would be of a more direct machine readable language such as a bar-stripe code or a magnetic strip.

Figure 2:
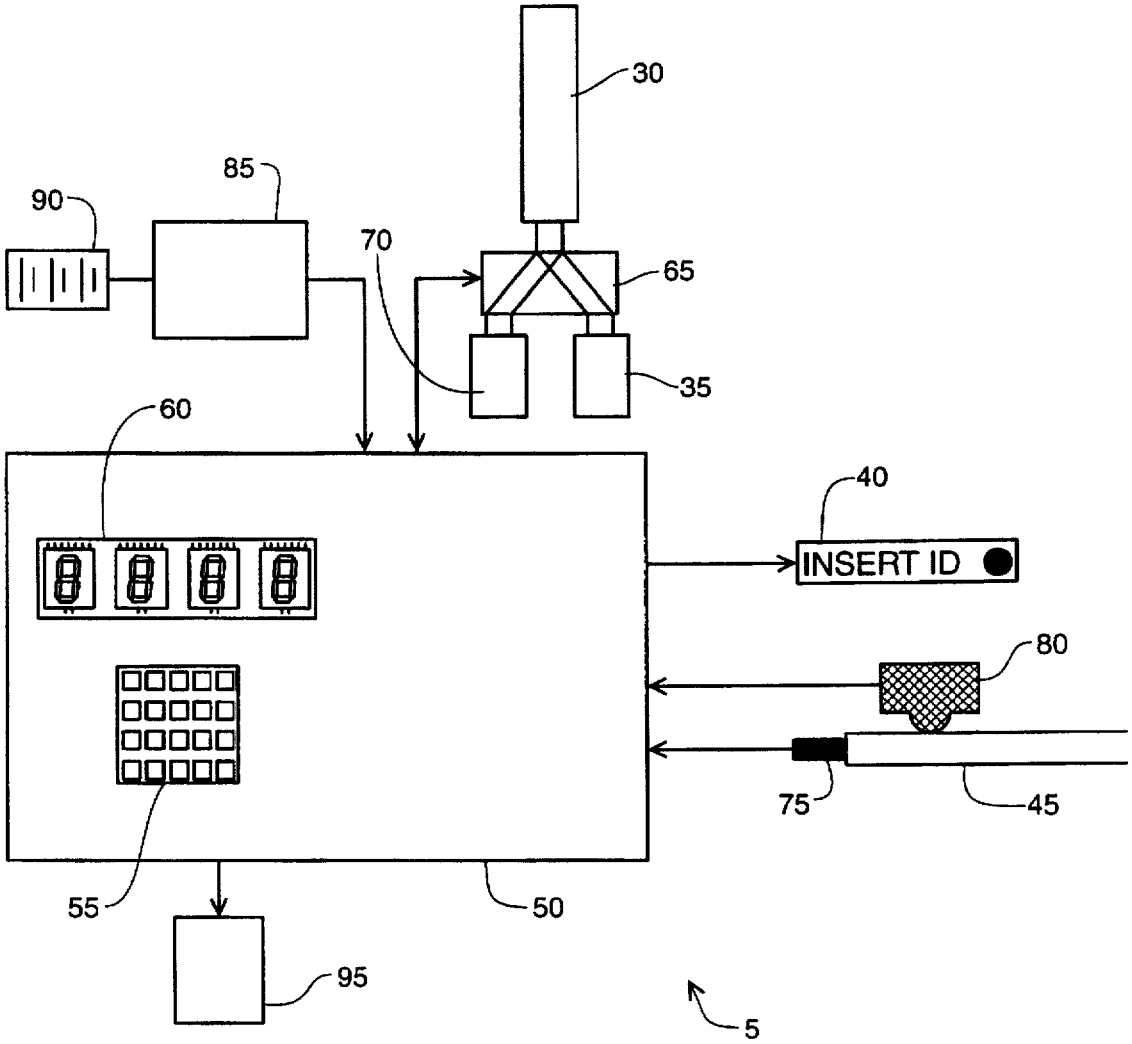
FIG. 2 is a block diagram arrangement of the major components of a dispensing security system for a vending machine.

Referring now to FIG. 2, a block diagram arrangement of the major components of a dispensing security system for a vending machine 5 is shown. A main processor unit 50 is provided to control all logic functions which will be described in greater detail below. The main processor unit 50 is also provided with an operator input keypad 55 and an operator output display 60. Both the operator input keypad 55 and the operator output display 60 are used by the vending machine owner or manager to input the current year, month, date and time. A legal tender routing means 65 is located physically in between the legal tender insertion slot 30 and the legal tender return chute 35. The legal tender routing means 65 also has the capability to route the legal tender (not shown) to a legal tender storage box 70 as shown. Located next to the identification insertion slot 45 is an insert limit switch 75 and an identification reader 80. The identification reader 80 is capable of reading a user's birth date using the various technologies as described under the FIG. 1 description above. Also shown as an output function of the main processor unit 50 is the ID INSERT light 40. Providing electrical power to the main processor unit 50 is the power supply 85. It is anticipated that the power supply 85 is powered from the same alternating electrical current supply as the vending machine in the case of alternating current electrically operated vending machines. Or in the case of non-electrically operated vending machines, the power supply 85 would be a replaceable battery. In either instance, the power supply 85 would be backed up by a battery 90 so the main processor unit 50 may retain the current year, month, date and time. This battery 90 is necessary for the case of power outages in alternating current electrically operated vending machines, and in the case of non-electrically operated vending machines during the replacement of the replaceable battery. Finally, a dispensing means 95 is shown for delivering the user selected product (not shown) to the user. It is anticipated that the dispensing means 95 would be electric solenoid actuators or electric motors used in the case of an alternating current electrically operated vending machine or of a battery operated solenoid capable of performing a mechanical interlock in the case of a non-electrically operated vending machine.

Figure 3:
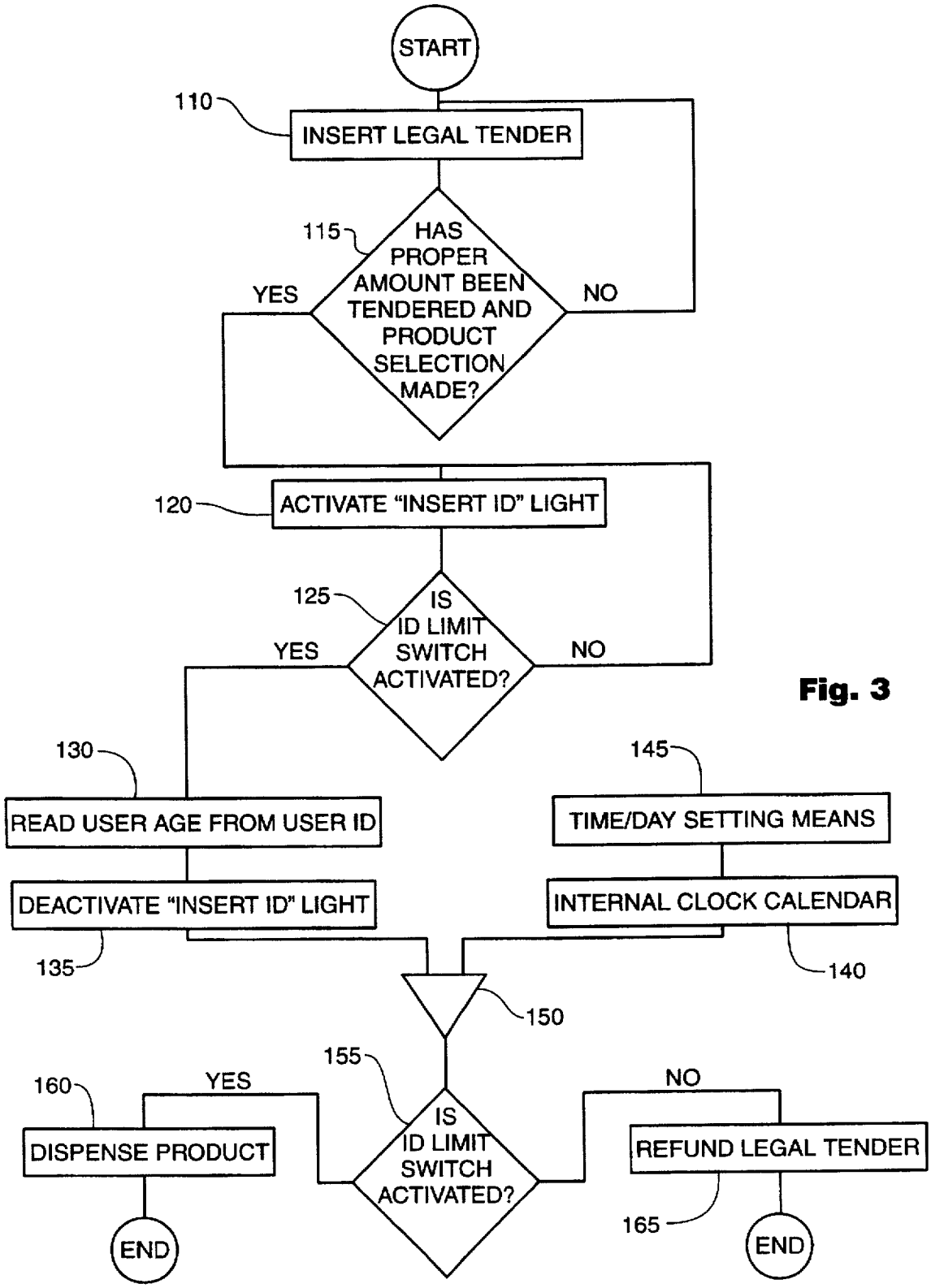
FIG. 3 is a flow chart diagram showing the methodology of the present invention.

Referring finally to FIG. 3, a flow chart diagram depicting the methodology of the present invention is shown. This methodology generally outlines the steps performed by the main processor unit 50 (as shown in FIG. 2) when a user attempts to make a purchase from a vending machine equipped with a dispensing security system for a vending machine 5 (as shown in FIG. 1). The functions shown in FIG. 3 can be implemented as subroutines in a program stored in the main processor unit 50 (as shown in FIG. 2). At a block 110, the sequence of purchasing a product begins. At an inquiry block 115, the sequence continues or returns to a loop state at block 110. If a positive answer is received at the inquiry block 115, the sequence directs a block 120 to activate the ID INSERT light 40 (as shown in FIGS. 1 and 2). At an inquiry block 125, the sequence continues or returns to a loop state at block 120. A positive response then directs the identification reader 80 (as shown in FIG. 2) to read the users age as depicted by a block 130 and then deactivate the ID INSERT light 40 (as shown in FIGS. 1 and 2) and depicted by a block 135. An internal clock calendar as depicted by a block 140 and set by operator input keypad 55 (as shown in FIG. 2) and the operator output display 60 (as shown in FIG. 2) and depicted by a block 145 are used by a comparator block 50 and an inquiry block 155 to determine if the user is of legal age. A positive answer directs the dispensing of the product as depicted by a block 160 or the refund of the legal tender as depicted by a block 165.

2. Operation of the Preferred Embodiment

In operation, the present invention can be utilized by the common user in a simple and effortless manner. To use the present invention with its preferred embodiment can best be described in conjunction with the pictorial illustration of FIG. 1 and the flow chart diagram of FIG. 3 depicting a dispensing security system for a vending machine.

A user purchases a product by viewing the selection through the product viewing area 15, inserting legal tender in the a legal tender insertion slot 30, and selecting a product via a selection means 25. At this point the main processor unit 50, directs the user to insert his or her identification card into the identification insertion slot 45 via the ID INSERT light 40. Depending on the users age as depicted by the flow chart diagram as shown in FIG. 3, the legal tender is retained and the selected product is dispensed through the receiving door 20, or the legal tender is refunded through the legal tender return chute 35.

The foregoing description is included to illustrate the operation of the preferred embodiment and is not meant to limit the scope of the invention. The scope of the invention is to be limited only by the following claims.

What is claimed is:

1. A security system for controlling, based upon a user's age, the dispensing of products from a vending machine, said security system comprising:

a main processor;

operator input means for inputting into said main processor information identifying a present date and a present time;

an identification insertion slot for receiving an identification card;

a legal tender return chute for returning money to a user;

identification reading means in connection with said identification insertion slot for acquiring a birth date from an identification card inserted into said identification insertion slot;

legal tender routing means in connection with said legal tender return chute for controlling the passage of money to or bypassing of money around said legal tender return chute;

said main processor configured to receive and store information from said operator input means and said identification reading means, said main processor configured to maintain the present date and the present time, said main processor configured to calculate an age from the birth date and the present date and to establish a comparison between said age and a legal age for purchasing a product; and said main processor configured to control said legal tender routing means based on said comparison, such that money is directed to said legal tender return chute when said age is less than said legal age, and such that money is bypassed around said legal tender return chute to permit dispensing of a product when said age is at least equal to said legal age.

2. The security system as described in claim 1, wherein said identification insertion slot can receive and said identification reading means can acquire birth date information from a standardized, state issued driver's license.

3. The security system as described in claim 1, wherein said operator input means comprises an input keypad.

4. The security system as described in claim 3, further comprising an operator output display in communication with said operator input means for providing an operator with visual verification of input.

5. The security system as described in claim 1, wherein said identification reading means comprises:

an insert limit switch connected to said identification insertion slot for stopping an identification card at a fixed point within said identification insertion slot and for signaling the presence of an identification card within said identification insertion slot; and an optical reader activated by said insert limit switch for transferring birth date information from an identification card to said main processor.

6. The security system as described in claim 1, further comprising an identification card prompt means for signaling to and prompting a user to insert an identification card into said identification insertion slot.

7. In a product dispensing and vending machine having a product viewing area, a product receiving door, a selection means for selecting a product, a legal tender insertion slot for inserting a payment tender, a legal tender return chute, and a dispensing means for dispensing products, wherein the improvement comprises:

an internal calendar clock for maintaining the present date and the present time;

operator input means for setting said internal calendar clock;

an identification insertion slot for receiving an identification card;

identification reading means in connection with said identification insertion slot for acquiring a birth date from an identity card inserted into said identification insertion slot;

an insert limit switch connected to said identification insertion slot for stopping an identification card at a fixed point within said identification insertion slot and for signaling the presence of an identification card within said identification insertion slot;

legal tender routing means in connection with and between said legal tender return chute and said legal tender insertion slot for controlling the passage of money to or bypassing of money around said legal tender return chute;

a main processor configured to receive and store information from said operator input means, said insert limit switch, and said identification reading means, said main processor configured to calculate an age from the birth date and the present date and to establish a comparison between said age and a legal age for purchasing a product; and said main processor configured to control said legal tender routing means based on said comparison, such that money is directed to said legal tender return chute when said age is less than said legal age, and such that money is bypassed around said legal tender return chute to permit dispensing of a product when said age is at least equal to said legal age.

8. The security system as described in claim 7, wherein said identification insertion slot can receive and said identification reading means can acquire birth date information from a standardized, state issued driver's license.

9. The security system as described in claim 7, wherein said operator input means comprises an input keypad.

10. In the security system as described in claim 7, the improvement further comprising an operator output display in communication with said operator input means for providing an operator with visual verification of input.

11. The security system as described in claim 7, wherein said identification reading means comprises an optical reader activated by said insert limit switch for transferring birth date information from an identification card to said main processor.

* * * * *